US006045143A

United States Patent [19]

Wrike

[11] Patent Number: 6,045,143

[45] **Date of Patent: *Apr. 4, 2000**

[54] TOE PLATE WITH DUAL FLANGES FOR IN-LINE SKATE FRAME

[75] Inventor: Michael C. Wrike, Jamestown, N.C.

[73] Assignee: Rike Industries, Inc., Jamestown, N.C.

[ * ] Notice: This patent is subject to a terminal disclaimer.

[21] Appl. No.: 09/132,836

[22] Filed: Aug. 12, 1998

Related U.S. Application Data

[63] Continuation of application No. 08/779,921, Jan. 9, 1997, Pat. No. 5,803,466.

[51] Int. Cl.[7] ..... A63C 17/06

[52] U.S. Cl. ..... 280/11.22; 280/11.27

[58] Field of Search ..... 280/11.16, 11.26, 280/11.22, 11.27, 11.28, 7.12, 7.13, 7.14

[56] References Cited

U.S. PATENT DOCUMENTS

| | | | |
|---|---|---|---|
| D. 354,539 | 1/1995 | Meibock et al. | D21/226 |
| 1,268,385 | 6/1918 | Paulsen | 280/11.22 |
| 3,880,441 | 4/1975 | Silver | 280/11.22 |
| 3,900,203 | 8/1975 | Kukulowicz et al. | 280/11.2 |
| 4,108,450 | 8/1978 | Cote | 280/11.22 X |
| 4,418,929 | 12/1983 | Gray | 280/11.23 |
| 4,657,265 | 4/1987 | Ruth | 180/7.13 |
| 4,659,095 | 4/1987 | Halvorsen | 280/11.27 |
| 4,666,169 | 5/1987 | Hamill et al. | 280/11.23 |
| 4,932,675 | 6/1990 | Olson et al. | 280/7.13 |
| 5,046,746 | 9/1991 | Gierveld | 280/11.22 |
| 5,092,614 | 3/1992 | Malewicz et al. | 280/11.22 |
| 5,129,663 | 7/1992 | Soo et al. | 280/7.14 |
| 5,184,834 | 2/1993 | Yu | 280/7.13 |
| 5,193,827 | 3/1993 | Olson | 280/7.13 |
| 5,199,726 | 4/1993 | Willett | 280/11.27 |
| 5,251,920 | 10/1993 | McHale | 280/11.19 |
| 5,253,884 | 10/1993 | Landers | 280/11.27 |
| 5,271,633 | 12/1993 | Hill, Jr. | 280/11.22 |
| 5,277,437 | 1/1994 | Moats | 280/11.23 |
| 5,314,199 | 5/1994 | Olson et al. | 280/7.13 |
| 5,331,752 | 7/1994 | Johnson et al. | 36/115 |
| 5,503,413 | 4/1996 | Belogour | 280/11.22 |
| 5,533,740 | 7/1996 | Lin | 280/11.22 |
| 5,549,310 | 8/1996 | Meibock et al. | 280/11.22 |
| 5,855,383 | 1/1999 | Harr et al. | 280/11.22 |

*Primary Examiner*—Michael Mar
*Attorney, Agent, or Firm*—Myers, Bigel, Sibley & Sajovec

[57] ABSTRACT

An in-line roller skate frame includes a toe plate including a downwardly extending flange pair which forms a sidewall mounting cavity therebetween. The sidewall and flange cavity are configured to releasably attach the sidewall to the skate frame and provide a distributed load bearing mounting surface therebetween. This dual flange mounting surface advantageously allows for improved performance characteristics such as handling and strength which is particularly attractive for aggressive skaters.

9 Claims, 3 Drawing Sheets

10
12
5
16
14
18

12
20
24
28b
22
28a
45
40
42
35
31
60
32
33
30
26
50a
18a
46
18
51a 52
50b
46
51
16
51b
18b
73
72
16
71
72
73

TOE PLATE WITH DUAL FLANGES FOR IN-LINE SKATE FRAME

This application is a continuation of 08/779,921, filed Jan. 9, 1997, now U.S. Pat. No. 5,803,466.

FIELD OF THE INVENTION

The present invention relates to in-line roller skates and, more particularly, to in-line roller skate frames.

BACKGROUND OF THE INVENTION

In-line roller skates typically comprise a boot, a frame, and a plurality of rollers or wheels mounted to the frame which are "in-line" (i.e., in serial longitudinal alignment held by transversely-disposed axles). The frame has a pair of spaced-apart downwardly extending sidewalls which define a wheel cavity, which receives the wheel axles and from which the partially recessed wheels downwardly extend. The frame also includes a boot-engaging structure positioned on top of the frame, typically comprising a toe plate and heel plate. As will be discussed below, the frame is important because it affects the strength, durability, and performance of the skate.

In-line skating has become extremely popular in both aggressive sport activities such as hockey and racing, as well as for exercise or leisure type recreational skating. Especially important for aggressive sporting activities is an in-line skate's ability to sustain shocks and perform well (and reliably) under highly stressed conditions such as sharp turns, jumps, sudden stops and even abrupt contact with hard surfaces. For example, when in-line roller skates are used by hockey players, conventional light weight frames can be bent or fractured when struck by a hockey stick, the hockey puck, another skate, or even the enclosed playing arena wall when "slammed" by another player. The sidewall components of the frame that form the wheel cavity are the most exposed and therefore most susceptible to such damage. The materials and designs of skate components have become very specialized as the number of varieties of activities have expanded. For example, on many skates the optimum wheel size varies as a function of the sport or activity for which the skate is used. As another example, many recently developed frames are formed out of a single thin piece of lightweight material that minimizes overall skate weight, thereby reducing the fatigue experienced by the skater.

If a sidewall on a conventional in-line roller skate having a one-piece wheel frame is damaged, the sidewall alone cannot be replaced; instead, the entire frame must be replaced. Disadvantageously, presently available frames are typically quite expensive due to both material and labor costs (i.e. the costs associated with casting or machining a single-piece frame and the high price of the light weight materials used to construct these frames). In addition, skaters who use their skates for several different activities also face frame replacement difficulties, as a separate frame is often required to accommodate the different sized wheels that provide optimum performance for each different activity.

In-line roller skates including multiple-piece frames have been described in the prior art, as evidenced, for example, by the skate designs disclosed in U.S. Pat. No. 5,277,437 to Moats, U.S. Pat. No. 4,666,169 to Hamill et al., and U.S. Pat. No. 4,418,929 to Gray. As such, these designs permit the replacement of damaged sidewalls without the replacement of the entire frame. However, these frames use sidewalls that include cross-members or other lateral projections to provide rigidity and strength to the frame. Increased strength improves the durability of the frame, while increased rigidity can improve skate responsiveness. Including such lateral projections necessitates either machining or separately casting each sidewall in the manufacturing process, and thus the cost of manufacturing an individual sidewall can be quite high. An additional disadvantage of these multi-piece frame configurations is that their sidewalls are configured for a specific side of the skate; thus, it is necessary to have both a left and right spare sidewall available.

Several additional difficulties with presently available in-line roller skate frames relate to the impact that performance-enhancing design modifications have had on the skate's durability and manufacturing cost. For example, frame configurations such as the skate disclosed in U.S. Pat. No. 5,092,614 to Malewicz proposed to have improved skate performance by decreasing the weight of the frame. However, modifying the frame to decrease weight generally decreases the strength and durability of the frame, increases the cost of producing it or both. Similarly, almost all conventional frames include lateral cross members that increase the skate's rigidity to provide for desired increased speed and responsiveness. However, as described above, forming sidewalls that include such cross-members requires additional machining or casting which can significantly affect the cost of the skate frame.

One solution is offered in co-pending and co-assigned U.S. patent application Ser. No. 08/573,660, filed Jan. 17, 1995, which discloses an in-line skate frame which has side walls that are devoid of any lateral projections. The side walls are positioned laterally of and rest against flanges extending downwardly from the heel and toe plates. However, the heel and toe plates are joined to the sidewalls with fasteners that protrude laterally beyond the sidewalls. This configuration can create stress points and reduce handling characteristics of the skates. Exposure of the protruding fasteners also makes then more susceptible to causing or incurring damage.

OBJECTS AND SUMMARY OF THE INVENTION

In view of the foregoing, it is an object of the present invention to provide an in-line skate frame that is durable, can be modularly repairable by including sidewalls which can be separated and singularly replaced, and provides responsive-handling performance characteristics.

It is a further object of the present invention to provide an in-line skate with a frame configured to have a load distributing mounting surface to provide strength and rigidity to the frame which also providing improved handling thereof responsive to a skater's directional movements.

These and other objects are satisfied by the present invention which includes an in-line roller skate with improved handling characteristics. The in-line roller skate includes a boot having a sole surface which toe and heel portions, a frame, associated sidewalls, and fasteners. The frame comprises a toe plate having an upper face and a lower face, with the upper face being affixed to the sole surface toe portion. The toe plate lower face includes two pair of spaced apart flanges extending downwardly therefrom and defining cavities therebetween. The heel plate has an upper face and a lower face, with the upper face being affixed to the sole surface heel portion. The lower face includes two pair of spaced apart flanges extending downwardly therefrom defining cavities therebetween. The in-line skate also includes first and second downwardly extending sidewalls having front and rear upper portions. The first sidewall is configured such that the rear upper portion is received into a corresponding one of the heel plate cavities and the front upper portion is received into a corresponding one of the toe plate cavities. The second sidewall is received into the opposing toe and heel plate cavities. The in-line skate also includes a plurality of fasteners for releasably attaching the first and second sidewalls to respective ones of the toe and heel plate flange pairs. Further included are a plurality of wheels rotatably mounted between the first and second sidewalls. The dual flange configuration advantageously provides increased frame rigidity, better durability, and a load distributing mounting surface. Additionally, the dual flange configuration provides an aesthetically desirable and unique frame thus improving the overall appearance of the in-line skate.

Alternatively, the boot itself could be manufactured in such a way as to include a dual flange support member integral therewith. This configuration can reduce the number of frame components such as separate toe and heel plates.

In a preferred embodiment, the flange pairs are configured to have a first flange and a second flange. The first flange is positioned to the outside of the frame and has a countersink fastener opening disposed therethrough. The first flange extends downwardly a greater distance than the second flange. The longer first flange allows for improved handling in response to a skater's aggressive movements such as sharp turns by distributing an increased portion of the generated forces or loads over a larger flange arm surface area.

Another aspect of the present invention is an in-line skate frame having the above-described characteristics. The frame can also include a countersink opening in one of the flanges to allow a fastener to be recessed therein. This advantageously protects the fastener from being exposed to unnecessary risk of damage.

Yet another aspect of the present invention is a repair kit for allowing for faster or more convenient sidewall replacement by allowing a broken or damaged sidewall to be individually detached from the frame. This can be carried out by removing fasteners from respective flange pairs, removing the damaged sidewall, and replacing it with a sidewall available in the repair kit. Thus, a skater or team coach does not need duplicate pairs of spare in-line skates, but instead can easily obtain the same equipment flexibility by employing a repair kit with at least one sidewall, for on site repair.

An additional aspect of the present invention is a method of mounting a sidewall of a frame for carrying the wheels of an in-line skate. The frame includes toe and heel plates, and the toe plate lower face includes two pair of spaced apart flanges extending downwardly therefrom, with each of the flange pairs defining a cavity therebetween. The frame also includes first and second sidewalls, each of which are separately attachable to the heel and toe plates. The wheels are rotatably mounted between the first and second sidewalls. The method steps comprise positioning the first sidewall to be received into corresponding ones of the toe and heel flange cavities of a respective toe and heel plate and fastening the first sidewall to one of the flange pairs on each of the respective toe and heel plates in a releasably detachable manner.

The fastening step may also include urging a fastener forward into aligned fastener openings positioned in the flange pairs and the first sidewall until the fastener is substantially countersunk to rest substantially flush against or recessed into the outer surface of one of the flanges, thereby providing a protected fastener and distributed load bearing mounting surface. The positioning step positions the desired sidewall into corresponding flange cavities of the respective toe and heel flange pairs.

The foregoing and other objects and aspects of the present invention are explained in detail in the specification set forth below.

DETAILED DESCRIPTION OF THE INVENTION

The present invention will now be described more fully hereinafter with reference to the accompanying drawings, in which preferred embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

The present invention relates to an in-line skate frame and associated method for replacing an in-line skate frame including components thereof. In the description of the present invention that follows, certain terms are employed to refer to the positional relationship of certain structures relative to other structures. As used herein, the term "longitudinal" and derivatives thereof refer to the general direction defined by the longitudinal axis of the boot or other footwear associated with an in-line skate that extends between the toe and the heel of the boot. As used herein, the terms "outer", "outward", "lateral" and derivatives thereof refer to the direction defined by a vector originating at the longitudinal axis of the boot and extending horizontally and perpendicularly thereto. Conversely, the terms "inner", "inward", and derivatives thereof refer to the direction opposite that of the outward direction. Together the "inward" and "outward" directions comprise the "transverse" direction.

Figures 1, 2:
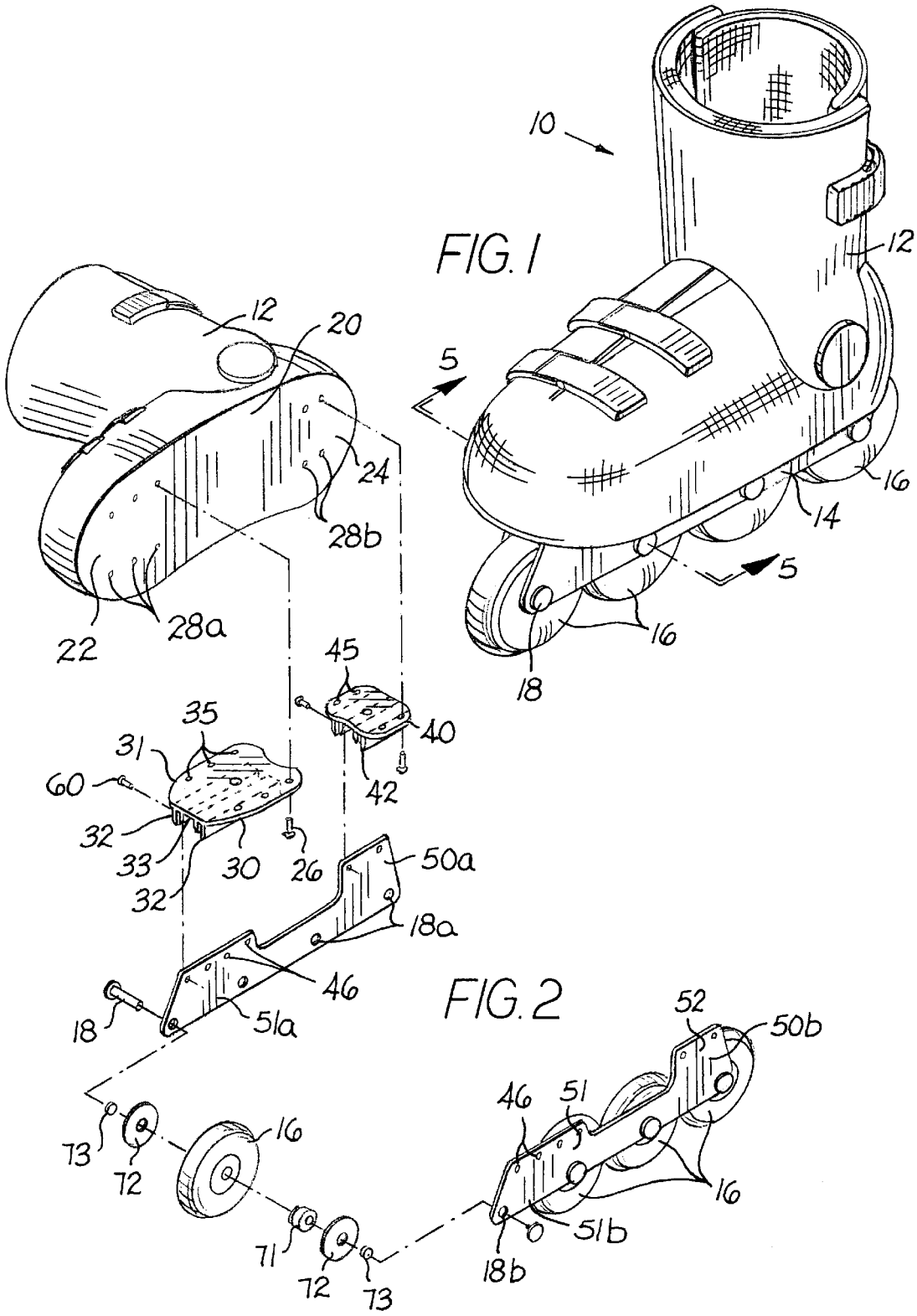
FIG. 1 is a perspective view of an assembled in-line roller skate of the present invention showing the boot, the wheel frame, and the wheels.
FIG. 2 is an exploded perspective view of the in-line roller skate of FIG. 1 illustrating interconnection of the wheels, frame components, and boot.

Referring now to the drawings, an in-line roller skate according to the present invention, generally designated at 10, is illustrated in FIG. 1. The skate 10 includes a boot 12 (which can also be a shoe or other similar footwear), a frame 14 attached to the underside thereof, and a plurality of wheels 16 that are rotatably and removably mounted on the frame 14 for rotation about their respective axles 18. The frame 14 includes a toe plate 30, a heel plate 40, and detachable sidewalls 50*a*, 50*b*.

As illustrated by the exploded view shown in FIG. 2, the boot 12 includes a sole surface 20 having a toe portion 22 and a heel portion 24 to which the frame 14 is attached. A bolt 26 is inserted through each of a plurality of openings 35 disposed about the horizontal surface of a toe plate 30. These bolts 26 are then inserted into machining threaded openings 28*a* disposed along the toe portion 22 of the sole surface 20. The openings 35, 28*a*, and the bolts 26, although illustrated as being the same size, may also correspondingly vary in diameter without affecting the fastening of the frame to the sole.

The bolts 26 are similarly inserted through each of a plurality of openings 45 disposed about the horizontal surface of the heel plate 40, and are inserted into matching threaded openings 28*b* disposed along the heel portion 24 of the sole surface 20. However, as would be readily understood by those skilled in the art, other alternative fastening means, such as rivets or high strength adhesives, can be used to secure the wheel frame 14 to the sole surface of the boot. As illustrated, the bolts 26 are shown as being insertable upwardly into the sole 20; however, the assembly can also be reversed such that the bolts 26 are inserted downwardly into the toe and heel plates 30, 40.

Figure 3:
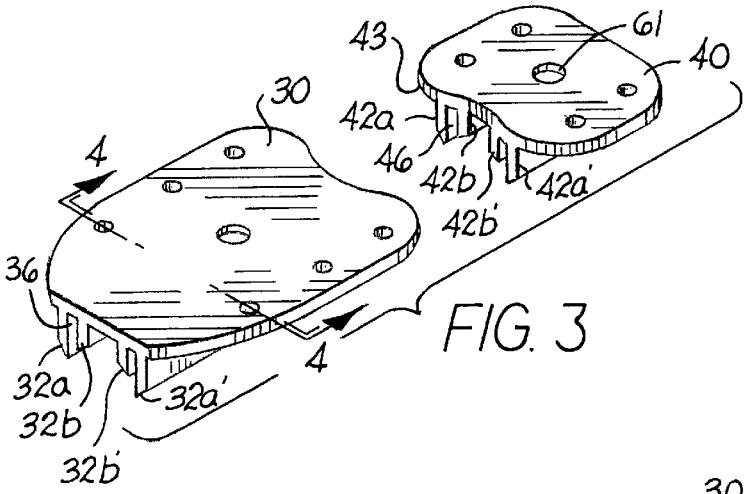
FIG. 3 is a top perspective view of the toe and heel plates and the load distributing mounting surface of a skate frame of the present invention.

As best illustrated by FIG. 3, the toe plate includes two pair of spaced apart flanges, designated 32*a*, 32*b* and 32*a'*, 32*b'*, respectively, which extend downwardly from a lower face 33. Each of the flange pairs 32 defines a cavity 36 therebetween. A plurality of aligned and spaced-apart openings 46*a*, 46*b*, 46*a'*, 46*b'* (FIG. 4) are included along the lateral faces of the flanges 32*a*, 32*b*, 32*a'*, 32*b'*, respectively.

Similarly, the heel plate 40 also includes two pair of spaced apart flanges, designated 42*a*, 42*b*, and 42*a'*, 42*b'*, respectively, which extend downwardly from its lower face 43 to define a cavity therebetween 46. It is preferred that each of the flange pairs extend longitudinally virtually the entire length of the toe or heel plate 30, 40.

The toe plate 30 and heel plate 40 are preferably constructed out of a relatively lightweight, low cost material, such as aluminum. Further, it is desirable that the toe and heel plate 30, 40 be constructed from a material which is easily machined, such as aluminum, in order to simplify their manufacture.

Figure 4:
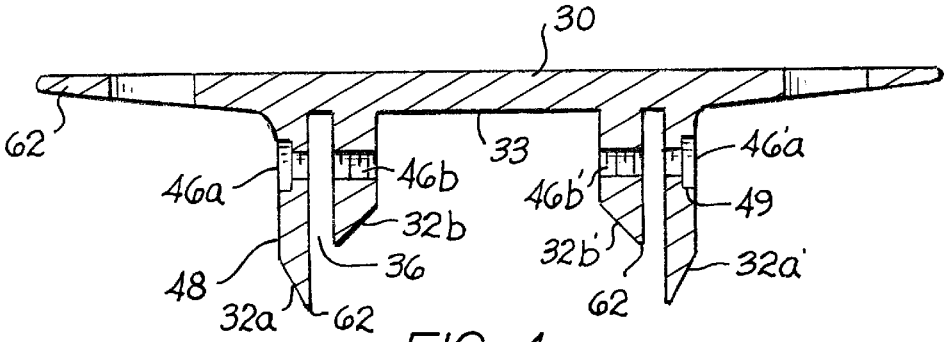
FIG. 4 is an enlarged cross-sectional view of a toe plate taken along lines 4—4 of FIG. 3.

As illustrated in FIGS. 3 and 4, at least one, and preferably both, of the flange pairs 32 is asymmetrically configured. For example, the outer flange 32*a* extends downwardly a greater distance from the toe plate lower surface 33 than the inner flange 32*b*. Alternatively, the flange pair could be symmetrically configured or the inner flange 32*b* be configured to be different in width from the opposing outer flange 32*a*. For example, the outer flange 32*a* could be longer than the inner flange 32*b*, while the inner flange 32*b* could be thicker than the outer flange 32*a*. It is preferred that the two sets of flange pairs 32*a*, 32*b*, and 32*a'*, 32*b'* are configured to be mirror images of one another about a vertical plane extending through the longitudinal axis of the frame. However, it will be appreciated by one of skill in the art that the invention is not limited thereto. Indeed, if a particular skater favors one or the other of his sides it may be advantageous to employ a stronger flange pair on one side of the plate component. Similar construction is also preferred for the heel plate 40.

In any event, the outer and inner flanges 32*a*, 32*b*, 32*a'*, 32*b'* should be sufficiently thick to provide the necessary rigidity and durability to the skate frame, while also having the material strength to support an opening positioned therethrough for securing the sidewall 50*a* into the cavity 36 by a fastener 60, as will be explained further below. Typical flange thicknesses include but are not limited to 0.10–0.25 inches. It will be appreciated that it is desirable that the weight of the frame be minimized such as by employing minimum frame dimensions.

Another way to minimize weight is to remove excess material from the frame (and other components) such as by providing bores 61 (FIG. 3) in strategic locations in the frame, thereby removing material without negatively impacting the performance characteristics of the skate. Further, as best illustrated by FIG. 4, it is preferred that all edges and transition regions be provided with a radius to provide stress relief, particularly at load bearing edges 62 of the frame and the intersections of the flanges of the heel and toe plate with their respective lower faces 33, 43.

As illustrated by FIG. 4, the flanges are preferably formed integrally with the toe plate 30. It is also preferred that the flanges include a chamfered or bevelled edge on the end opposing the toe plate lower surface 33. The flanges include a plurality of sidewall fastener openings 46 which are sized to receive fasteners 60.

The dual flange configuration of the present invention advantageously allows a countersink recess 49, 49' to be positioned on the outer lateral surface 48 by one of the flanges 32*a*, such that a fastener 60 can be advanced into the countersink to be substantially flush with or recessed into the outer lateral surface 48 of the flange 32*a*. This countersink alternative, although not required, is preferred in that it helps to protect the fastener 60 against exterior impact forces and can also provide a stronger joint.

Figure 5:
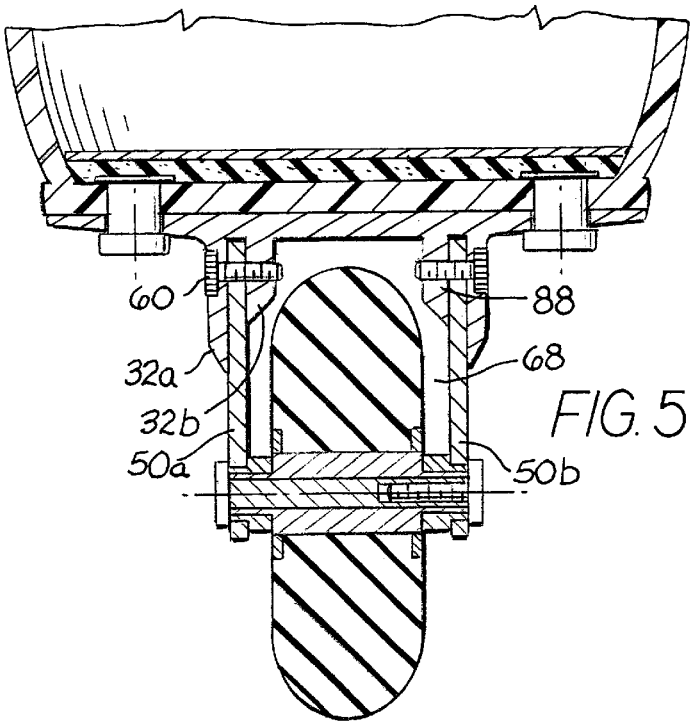
FIG. 5 is a greatly enlarged cross-sectional view of an assembled boot and frame taken along lines 5—5 of FIG. 1.

FIGS. 2 and 5 best illustrate the side walls 50*a*, 50*b*. The front and rear upper portions 51, 52 of the sidewalls 50*b*, 50*b* are configured to be received into the cavities formed by the flange pairs 32, 42 of the toe or heel plates 30, 40. A plurality of fasteners 60 secure the sidewall 50*a* positioned in the cavity 36. The frame 14 is constructed by attaching the upper portion 51, 52 of a sidewall 50*a*, 50*b* to the opposing inner faces of the flanges 32*b*, 32*b*, 42*a*, 42*b*. The bolts 60 are inserted through aligned openings 46*a*, 46*b*, 46*a'*, and 46*b*, in the flange pairs 32, 42 and the sidewalls 50*a*, 50*b*, respectively. As will be readily understood by those skilled in the art, other releasable fastening means can be employed to releasably attach sidewalls 50*a*, 50*b* to toe plate 30 and heel plate 40.

As shown in FIG. 5, the upper portions of sidewalls 50*a*, 50*b* are insertable into the cavities 36 of the flange pairs 32*a*, 32*b*, 32*a'*, 32*b'* and are sized and configured to contact the inner lateral faces of the flanges 32*a*, 32*b*, 32*a'*, 32*b'* upon securing the fasteners 60. Similarly, the cavities 36 are likewise sized and configured to receive corresponding sidewall upper portions to provide a snug or abutting fit therewith. This tight fit of corresponding sidewall upper portions and flanges 32*a*, 32*b* advantageously provides a load distributing mounting surface and also provides improved skate performance responsive to skater movements.

Although as described herein, the toe plate and heel plate are typically similarly configured to each include dual flanges, it will be appreciated by those of skill in the art that the invention is not limited thereto. For example, the toe plate 30 alone could be configured to comprise dual flanges while the heel plate could be configured to include a single mounting flange (not shown) as well as the reverse.

Figure 6:
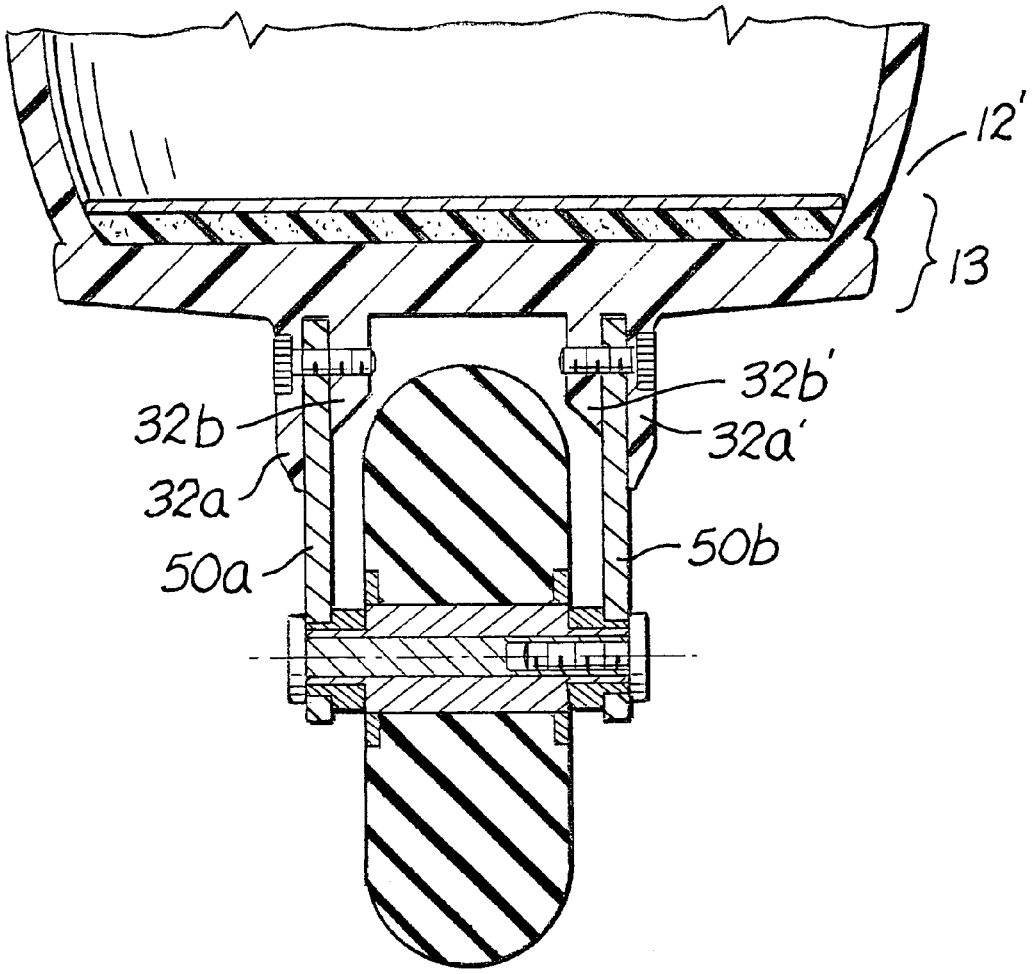
FIG. 6 is an alternative embodiment of an assembled boot of FIG. 5 illustrating an integral boot and dual flange configuration.

An alternative embodiment of a skate assembly of the present invention is illustrated in FIG. 6. A skate with a boot 12' and an integral body 13 includes dual flanges 32*a*, 32*b*, 32*a'*, 32*b'* without the need for separate toe and heel plates. For example, a molded polymer or carbon reinforced fiber sole/frame body combination can be manufactured so that a boot portion to include the downwardly extending dual frames. In such a situation, the dual flange configuration can, like the separate toe and heel plate flanges described hereinabove, be spaced apart under substantially the corresponding boot heel and toe portions, or can extend further than the heel and toe areas and can even extend continuously along the length of the boot (not shown). These alternatives allow for more fasteners to be optionally employed to secure the sidewalls along more area of the skate thereby allowing more evenly spaced force distributions onto the fasteners and associated apertures.

As shown in FIG. 2, the sidewalls 50*b*, 50*b* include a plurality of longitudinally spaced-apart apertures 46 are positioned in the front and rear upper portions 51, 52 of the sidewalls. The apertures 46 are spaced so as to overlie the openings 46*a*, 46*b*, 46*a'*, 46*b'* in the corresponding lateral faces of the toe plate flanges 32*a*, 32*b*, 32*a'*, 32*b'* and the openings 46*a*, 46*b*, 46*a'*, 46*b'* in the heel plate flanges 42*a*, 42*b*, 42*a'*, 42*b'*. FIG. 4 best illustrates the associated aligned openings 46*a*, 46*b* in the toe plate flanges 32*a*, 32*b* and the cavity 36. Upon assembly, as shown in FIG. 5, a fastener 60 is transversely extended through aligned openings in the sidewall 50*a* and flange pair 32*a*, 32*b*. It is preferred that the fasteners 60 be releasably attached to the frame flanges 32*a*, 32*b*, 32*a'*, 32*b'* and sidewalls 50*a*, 50*b* so that if one of the sidewalls needs to be removed from the skate frame to be replaced, it can easily be removed conveniently without special tools or skills. It is also preferred that the two sidewalls 50*a*, 50*b* are substantially structurally identical so that the number of spare sidewalls needed can be minimized and a sidewall replaced without regard to the frame placement of same. Thus, a skate frame repair kit having one or more or spare sidewalls (preferably interchangeably either a left or right outerwall) can be conveniently and easily provided. Thus, individual sidewalls 50*a*, 50*b* can be releasably replaced into and out of the flange cavities 36.

As illustrated in FIGS. 1 and 2, the in-line skate 10 also includes a plurality of wheels 16 rotatably mounted between the first and second sidewalls 50*a*, 50*b*. The number of wheels can vary but are typically present in numbers of between three to six. As illustrated by FIG. 5, when the frame 14 is assembled, the sidewalls 50*a*, 50*b*, along with the toe plate and heel plate 30, 40, define a cavity 68 within which the wheels 16 of the skate reside. The sidewalls 50*a*, 50*b* each includes along their lower portions 51*a*, 51*b* a plurality of longitudinally spaced-apart openings 18*a*, 18*b*, each of which receives one of a plurality of wheel axles 18. The skate wheels 16 are rotatably mounted upon the wheel axles 18. Each wheel (FIG. 2) includes a bearing 71 that extends transversely through its center through which an axle 18 extends and a pair of hubs 72 that circumferentially surround opposite ends of a bearing 71. Spacers 73 separate the axle 18 from the openings 18*a*, 18*b* in each side wall 50*a*, 50*b*. Those skilled in the art will appreciate that, although the wheel configuration described herein is preferred, other wheel configurations are also suitable for use with the present invention. Preferably, the wheels are formed from urethane or another polymeric material, but can also be formed of wood, metal, composites, or a composite mixture of such materials. Further, the exemplary in-line roller skate 10 could include more, or fewer wheels 16 than the four illustrated herein as well as multiple wheels rotatably mounted on each axle 18.

As best illustrated in FIG. 5, the frame sidewalls 50*a*, 50*b* according to the present invention are preferably devoid of lateral projections. This configuration simplifies their manufacture, the sidewalls 50*a*, 50*b* can be formed by simply cutting or pressing the appropriate shape from a desired material advantageously not requiring additional machining steps. As a result, light-weight, high strength materials such as titanium, which can improve skate performance but are typically difficult to machine, can be employed; thus, machining reducing the material thickness of the sheet material in the forming process is not required. Although machined sidewalls 50*a*, 50*b* are preferred, cast, forged or other forming methods can also be employed.

A related method of mounting a sidewall of a frame which carries an in-line skate can now be advantageously employed. The method includes positioning a first sidewall front and rear upper portions 51, 52 to be received into corresponding flange cavities 36, 46, respectively, of the toe and heel plates 30, 40. The sidewall is then fastened to the flange pairs 32, 42 in a releasably detachable manner. The outer flange preferably includes a recessed countersunk opening 49, 49', and the fastener 60 is urged forward such that the fastener head rests against the countersink recess, which protects the fastener head and provides a distributed load bearing mounting surface.

An additional advantage provided by the present invention is that the skate frame 14 has increased lateral thickness in the adjoining area 88 of the upper portion of the sidewalls 51, 52 and the flange pairs 32, 42. As illustrated in the cross-sectional view of FIG. 5, the increased thickness improves the rigidity of the frame, which can result in corresponding improvements in skate speed, durability, easier assembly alignment, handling, and strength. Additionally and advantageously, the additional lateral thickness allows for a countersunk assembly screw.

A further advantage of the present invention is the ability to provide sidewalls 50*a*, 50*b* in different colors (not shown). This may be desirable to certain team skaters to display color as part of a uniform appearance. A particularly preferred coloring method is anodizing, which comprises electrically treating a sidewall so that a colored anodic coating is formed on the surface thereof. See generally N. Irving Sax and Richard J. Lewis, Sr., *Hawley's Condensed Chemical Dictionary* at 84 (11th ed. 1987) for a discussion of anodizing techniques. The increased surface area of the load distributing configuration also provides additional area upon which to accent a player's color or team logo, advantageously setting off the skate frame and allowing a team to design a frame with a unique and individual appearance.

Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An in-line roller skate, comprising:

a boot having a sole surface with toe and heel portions; and a frame, comprising:

a toe plate having an upper surface affixed to said sole surface toe portion and a pair of spaced apart downwardly opening cavities, each of said toe plate cavities having an inner wall and an outer wall directly attached to a lower surface of said toe plate;

a heel plate having an upper surface affixed to said sole surface heel portion and a pair of spaced apart downwardly opening cavities, each of said heel plate cavities having an inner wall and an outer wall directly attached to a lower surface of said toe plate;

separate first and second downwardly extending sidewalls having front and rear upper portions, wherein said first sidewall is configured such that said rear upper portion is received into a corresponding one of said heel plate cavities and said front upper portion is received into a corresponding one of said toe plate cavities, and wherein said second sidewall is received into the other opposing said toe and heel plate cavities;

a plurality of fasteners for securing said first and second sidewalls within respective ones of said toe and heel plate cavities, each of said fasteners extending through one of said sidewalls and a cavity inner wall; and a plurality of wheels rotatably mounted between said first and second sidewalls.

2. An in-line skate according to claim 1, wherein each of said cavities is sized to receive said corresponding sidewall upper portion such that said inner and outer walls of said heel and toe plate cavities contact opposing sides of said corresponding sidewall upper portion to provide a load distributing mounting surface.

3. An in-line skate according to claim 1, wherein said first and second sidewalls are substantially structurally identical.

4. An in-line skate frame, comprising:

a toe plate having an upper surface adapted to be affixed to a sole surface toe portion of a boot, and a pair of spaced apart downwardly opening cavities, each of said toe plate cavities having an inner wall and an outer wall directly attached to a lower surface of said toe plate;

a heel plate having an upper surface adapted to be affixed to a sole surface heel portion of the boot, and a pair of spaced apart downwardly opening cavities, each of said toe plate cavities having an inner wall and an outer wall directly attached to a lower surface of said toe plate;

first and second downwardly extending sidewalls having front and rear upper portions, wherein said first sidewall is configured such that said rear upper portion is received into a corresponding one of said heel plate cavities and said front upper portion is received into a corresponding one of said toe plate cavities, and wherein said second sidewall is received into the other opposing said toe and heel plate cavities; and a plurality of fasteners for securing said first and second sidewalls within respective ones of said toe and heel plate cavities, each of said fasteners extending through one of said sidewalls and a cavity inner wall.

5. An in-line skate frame according to claim 4, wherein each of said cavities is sized to receive said corresponding sidewall upper portion such that said inner and outer walls of said heel and toe plate cavities contact opposing sides of said corresponding sidewall upper portion to provide a load distributing mounting surface.

6. An in-line skate according to claim 4, wherein said first and second sidewalls are substantially structurally identical.

7. An in-line roller skate, comprising:

a boot having a sole surface with toe and heel portions; and a frame, comprising:

a toe plate having an upper surface affixed to said sole surface toe portion and at least three projections mounted directly to a lower surface of said toe plate and extending downwardly from said lower surface, said projections defining a pair of spaced apart downwardly opening cavities;

a heel plate having an upper surface affixed to said sole surface heel portion and at least three projections mounted directly to said toe plate and extending downwardly from said lower surface, said projections defining a pair of spaced apart downwardly opening cavities;

separate first and second downwardly extending sidewalls having front and rear upper portions, wherein said first sidewall is configured such that said rear upper portion is received into a corresponding one of said heel plate cavities and said front upper portion is received into a corresponding one of said toe plate cavities, and wherein said second sidewall is received into the other opposing said toe and heel plate cavities;

a plurality of fasteners for securing said first and second sidewalls within respective ones of said toe and heel plate cavities, each of said fasteners extending through one of said sidewalls and a cavity inner wall; and a plurality of wheels rotatably mounted between said first and second sidewalls.

8. An in-line skate according to claim 7, wherein an outermost one of said toe plate projections has a lower edge that extends a lesser distance from said toe plate upper surface than a lower edge of an inner projection.

9. An in-line skate according to claim 7, wherein each of said fasteners extends through one of said sidewalls and an inner one of said toe plate projections or an inner one of said heel plate projections.

* * * * *

UNITED STATES PATENT AND TRADEMARK OFFICE

CERTIFICATE OF CORRECTION

PATENT NO. : 6,045,143

DATED : April 4, 2000

INVENTOR(S) : Michael C. Wrike

It is certified that error appears in the above-identified patent and that said Letters Patent is hereby corrected as shown below:

Column 5, line 6, please correct "machining" to read – matching --.

Column 6, line 32, please correct "50b" to read -- 50a --.

Column 6, line 38, please correct "32b" to read -- 32a --.

Column 7, line 15, please correct " 50b" to read -- 50a --

Column 7, line 35, please correct "or" to read --of --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*